US010733955B2

(12) United States Patent
Hayek et al.

(10) Patent No.: US 10,733,955 B2
(45) Date of Patent: Aug. 4, 2020

(54) DEVICES AND METHODS TO DISPLAY ALARM AND HOME EVENTS ON VIDEO MONITORS

(71) Applicant: The ADT Security Corporation, Boca Raton, FL (US)

(72) Inventors: Charbel Hayek, Boca Raton, FL (US); Steven Else, Deerfield Beach, FL (US); Raymond North, Baco Raton, FL (US)

(73) Assignee: The ADT Security Corporation, Boca Raton, FL (US)

( * ) Notice: Subject to any disclaimer, the term of this patent is extended or adjusted under 35 U.S.C. 154(b) by 0 days.

(21) Appl. No.: 16/059,843

(22) Filed: Aug. 9, 2018

(65) Prior Publication Data

US 2019/0051265 A1 Feb. 14, 2019

Related U.S. Application Data

(60) Provisional application No. 62/543,692, filed on Aug. 10, 2017.

(51) Int. Cl.

| | |
|---|---|
| ***G08B 5/00*** | (2006.01) |
| ***G09G 5/00*** | (2006.01) |
| ***G08B 25/00*** | (2006.01) |
| ***G08B 25/08*** | (2006.01) |

(52) U.S. Cl.

CPC ..... *G09G 5/006* (2013.01); *G08B 25/002* (2013.01); *G08B 25/009* (2013.01); *G08B 25/08* (2013.01); *G09G 5/005* (2013.01); *G09G 2340/12* (2013.01); *G09G 2370/06* (2013.01); *G09G 2370/12* (2013.01)

(58) Field of Classification Search

CPC ... G09G 5/006; G09G 2370/12; G08B 25/002
USPC ..... 340/691.6
See application file for complete search history.

(56) References Cited

U.S. PATENT DOCUMENTS

| | | | | |
|---|---|---|---|---|
| 8,848,057 | B2 * | 9/2014 | Xu | G08B 13/1961 348/143 |
| 9,043,832 | B2 * | 5/2015 | Wang | G08B 27/008 348/744 |
| 2003/0106070 | A1 * | 6/2003 | Saam | H04N 5/445 725/135 |
| 2003/0121059 | A1 * | 6/2003 | Ramaswamy | H04N 5/44513 725/141 |
| 2005/0285942 | A1 * | 12/2005 | Lin | G08B 13/19645 348/155 |
| 2006/0171453 | A1 * | 8/2006 | Rohlfing | G08B 13/19632 375/240.01 |
| 2006/0255931 | A1 * | 11/2006 | Hartsfield | G08B 13/19656 340/538.11 |

(Continued)

*Primary Examiner* — Naomi J Small
(74) *Attorney, Agent, or Firm* — Christopher & Weisberg, P.A.

(57) ABSTRACT

An overlay device for premises status message display on a video monitor is provided. The overlay device includes a processor in communication with a memory, the memory storing instructions, which when executed by the processor, cause the processor to: receive a premises status message from at least one premises device, receive a media signal for display on the video monitor, combine the media signal with the premises status message, and transmit the combined media signal and premises status message for display of the combination of the media signal and the premises status message by the video monitor.

18 Claims, 12 Drawing Sheets

(56) References Cited

U.S. PATENT DOCUMENTS

| | | | | |
|---|---|---|---|---|
| 2007/0039036 | A1* | 2/2007 | Sullivan | H04N 7/163<br>725/133 |
| 2009/0251526 | A1* | 10/2009 | Book | H04N 7/148<br>348/14.01 |
| 2011/0030016 | A1* | 2/2011 | Pino, Jr. | H04L 12/2818<br>725/80 |
| 2011/0313856 | A1* | 12/2011 | Cohen | G06Q 30/02<br>705/14.49 |
| 2013/0135097 | A1* | 5/2013 | Doezema | G08B 21/0446<br>340/539.13 |
| 2014/0039901 | A1* | 2/2014 | Mosko | H04M 11/066<br>704/500 |
| 2015/0332585 | A1* | 11/2015 | H.M. | G08B 25/014<br>704/225 |
| 2016/0191990 | A1* | 6/2016 | McCarthy, III | H04N 21/43615<br>725/80 |
| 2017/0064412 | A1* | 3/2017 | Taxier | H04N 21/8133 |

* cited by examiner

DEVICES AND METHODS TO DISPLAY ALARM AND HOME EVENTS ON VIDEO MONITORS

CROSS-REFERENCE TO RELATED APPLICATION

This application is related to and claims priority to U.S. Provisional Patent Application Ser. No. 62/543,692, filed Aug. 10, 2017, entitled DEVICES AND METHODS TO DISPLAY ALARM AND HOME EVENTS ON TV SCREENS, the entirety of which is incorporated herein by reference.

FIELD

This disclosure relates to premises security and lifestyle control systems and in particular to notification to a user of security or lifestyle events.

BACKGROUND

The demand for systems that monitor homes and businesses for alarm and lifestyle conditions has continued to grow as more home and business owners seek to protect their premises from various hazards and threats such as intrusion, fire, carbon monoxide and flooding, or to control lifestyle systems such as lighting, thermostats and energy management devices.

When a sensor such as a motion detector is triggered, a representative at a remote monitoring center receives an alarm event code and initiates a response process, including contacting a homeowner or others on a contact list and/or first responders such as local firefighters and/or police to request a dispatch to the premises.

For example, a remote monitoring center may include a remote life safety monitoring center that monitors life safety features associated with a control unit at the premises in which the remote monitoring center receives life safety data from the control unit. For example, with respect to fire and carbon monoxide detectors/sensors, life safety data may include at least one carbon monoxide readings, smoke detection reading, sensor location and time of reading, among other related to these detectors that may be communicated to the remote monitoring center. In yet another example, with respect to a door contact detector, life safety data may include at least one of sensor location and time of detection, among other data related to the door contact detection that may be communicated to the remote monitoring center 20.

Alarm event data from the premises may be used by the remote monitoring center in running through various life safety response processes in notifying the owner of the premises, determining whether an actual alarm event is occurring at the premises, and notifying any appropriate response agency (e.g., police, fire, emergency response).

The same or separate remote monitoring center may also include a life style system/service that allows for various life style features associated with the control. The remote life style system may receive life style data from the control unit. For example, with respect to temperature control, life style data may include thermostat readings. In yet another example, with respect to video capture devices, life style data may include at least one of captured images, video, time of video capture and video location, among other data related to video capture devices that may be communicate to the remote monitoring center. The remote monitoring center may also provide updates to the control unit such as updates to features associated with life safety and/or life style operating system. Those of ordinary skill in the art will appreciate that video and other data may also be used by the life safety monitoring center These systems do not readily allow a user to easily see alarm events or obtain other information from the alarm system, whether life safety or life style, because the user must be at or near a panel or have a wireless device such as a smartphone running an application with them. The result is that that there is a lack of real-time feedback of alarm or lifestyle events, as they occur, to a user at the premises.

SUMMARY

According to one aspect of the invention, an overlay device for premises status message display on a video monitor is provided. The overlay device includes a processor in communication with a memory, the memory storing instructions, which when executed by the processor, cause the processor to: receive a premises status message from at least one premises device, receive a media signal for display on the video monitor, combine the media signal with the premises status message, and transmit the combined media signal and premises status message for display of the combination of the media signal and the premises status message by the video monitor.

According to one embodiment of this aspect, a high definition multimedia interference (HDMI) interface including an HDMI input port and an HDMI output port, the receiving of the media signal and transmitting of the combined media signal occurring via the HDMI interface. According to one embodiment of this aspect, the memory contains further instructions, which when executed by the processor, cause the processor to: determine the premises status message correspond to a premises condition for immediate display on the video monitor, and when the video monitor is powered OFF, initiate a power ON sequence to power the video monitor to an ON state to display the premises status message indicating the premises condition.

According to one embodiment of this aspect, the premises status message is caused to be displayed in a picture-in-picture format. According to one embodiment of this aspect, the overlay device is responsive to a wirelessly transmitted remote signal that changes the displayed premises status message. According to one embodiment of this aspect, the memory contains further instructions, which when executed by the processor, cause the processor to change a volume of sound of the video monitor when displaying the premises status message.

According to one embodiment of this aspect, the media signal is a television signal received from one of a cable television provider and satellite television provider. According to one embodiment of this aspect, the display of the combination of the media signal and the premises status message by the video monitor includes superimposing the premises status message over a displayed video of the media signal. According to one embodiment of this aspect, the premises device is a sensor device.

According to another aspect of the disclosure, a method for an overlay device for premises status message display on a video monitor is provided. A premises status message is received from at least one premises device. A media signal for display on the video monitor is received. The media signal is combined with the premises status message. The combined media signal and premises status message are transmitted for display of the combination of the media signal and the premises status message by the video monitor.

According to one embodiment of this aspect, the receiving of the media signal and transmitting of the combined media signal is performed via an HDMI interface of the overlay device, the HDMI interface including an HDMI input port and an HDMI output port. According to one embodiment of this aspect, a determination is made that the premises status message corresponds to a premises condition for immediate display on the video monitor, and when the video monitor is powered OFF, a power ON sequence is initiated to power the video monitor to an ON state to display the premises status message indicating the premises condition. According to one embodiment of this aspect, the premises status message is caused to be displayed in a picture-in-picture format.

According to one embodiment of this aspect, the overlay device is responsive to a wirelessly transmitted remote signal that changes the displayed premises status message. According to one embodiment of this aspect, a volume of sound of the video monitor is changed when displaying the premises status message. According to one embodiment of this aspect, the media signal is a television signal received from one of a cable television provider and satellite television provider.

According to one embodiment of this aspect, the display of the combination of the media signal and the premises status message by the video monitor includes superimposing the premises status message over a displayed video of the media signal. According to one embodiment of this aspect, the premises device is a sensor device.

According to another aspect of the invention, an overlay device for premises status message display on a video monitor is provided. The overlay device includes a processor in communication with a memory, the memory storing instructions, which when executed by the processor, cause the processor to: receive a premises status message from at least one premises device, the at least one premises device include at least one sensor, receive a media signal for display on the video monitor, combine the media signal with the premises status message, and transmit the combined media signal and premises status message for display of the combination of the media signal and the premises status message by the video monitor. The display of the combination of the media signal and the premises status message by the video monitor includes superimposing the premises status message over a displayed video of the media signal. The premises status message indicates an alarm condition at a premises.

According to one embodiment of this aspect, the memory contains further instructions, which when executed by the processor, cause the processor to determine the premises status message is for immediate display on the video monitor, and when the video monitor is powered OFF, initiate a power ON sequence to power the video monitor to an ON state to display the premises status message indicates the alarm condition at the premises.

BRIEF DESCRIPTION OF THE DRAWINGS

A more complete understanding of embodiments described herein, and the attendant advantages and features thereof, will be more readily understood by reference to the following detailed description when considered in conjunction with the accompanying drawings wherein.

DETAILED DESCRIPTION

Figure 1:
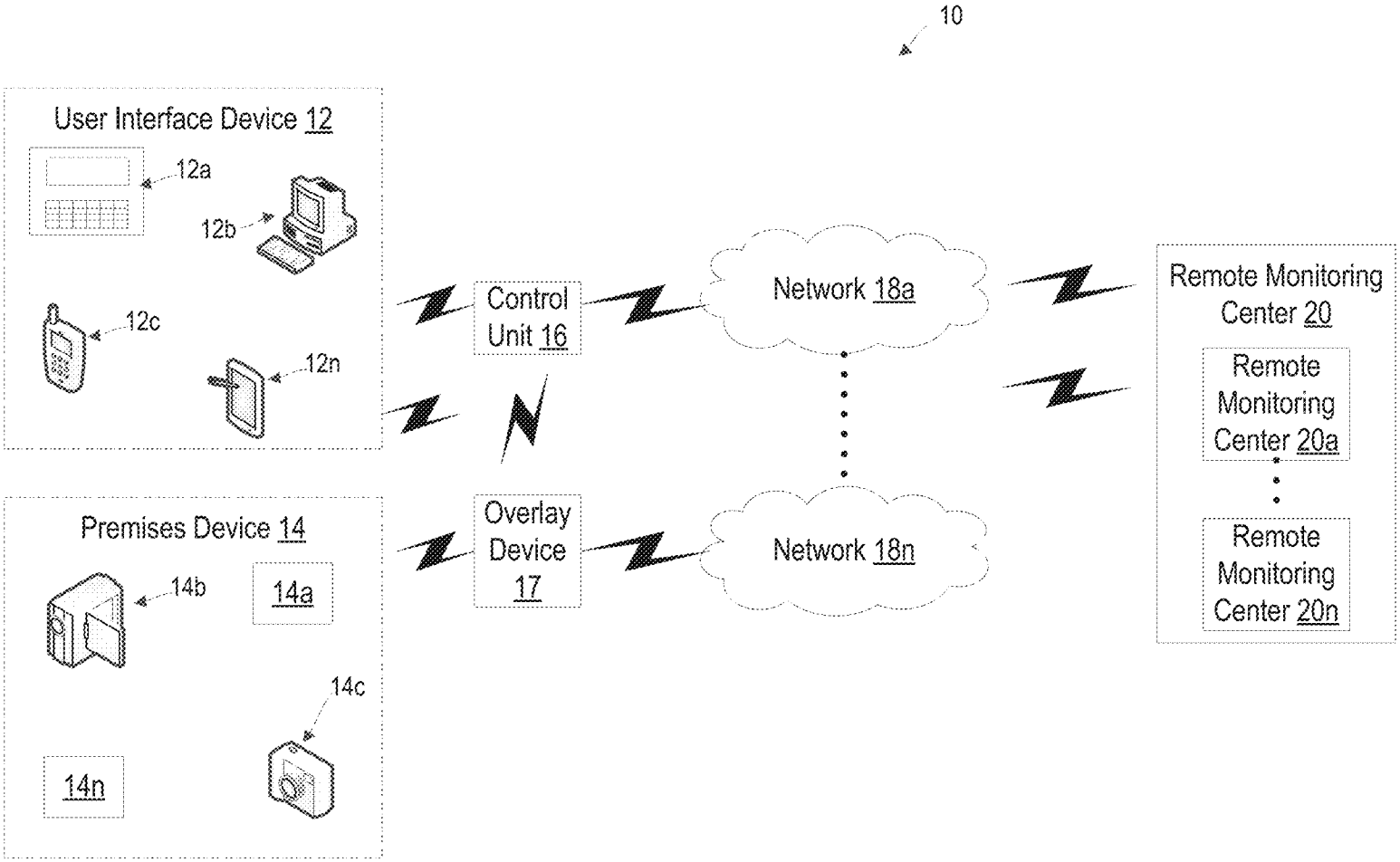
FIG. 1 is a block diagram of a security control system having an overlay device.

Before describing in detail exemplary embodiments, it is noted that the embodiments reside primarily in combinations of apparatus components and processing steps related to notification to a user of security or lifestyle events. Accordingly, the system and method components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Some embodiments provide a capability to inform television users of alarms in progress and other important monitoring or lifestyle messages, herein referred to collectively as premises status messages, while watching television or to turn on the television in the event of premises status messages to be displayed on the television. As used herein, media signal includes one or more of a video signal, television signal, broadcast video signal, image signal, and/or other type of signal contain media that is capable of being displayed by a video monitor. As used herein, video monitor includes one or more of television monitor and/or other type of monitor capable of displaying a media signal. Two cases are described.

Figure 2:
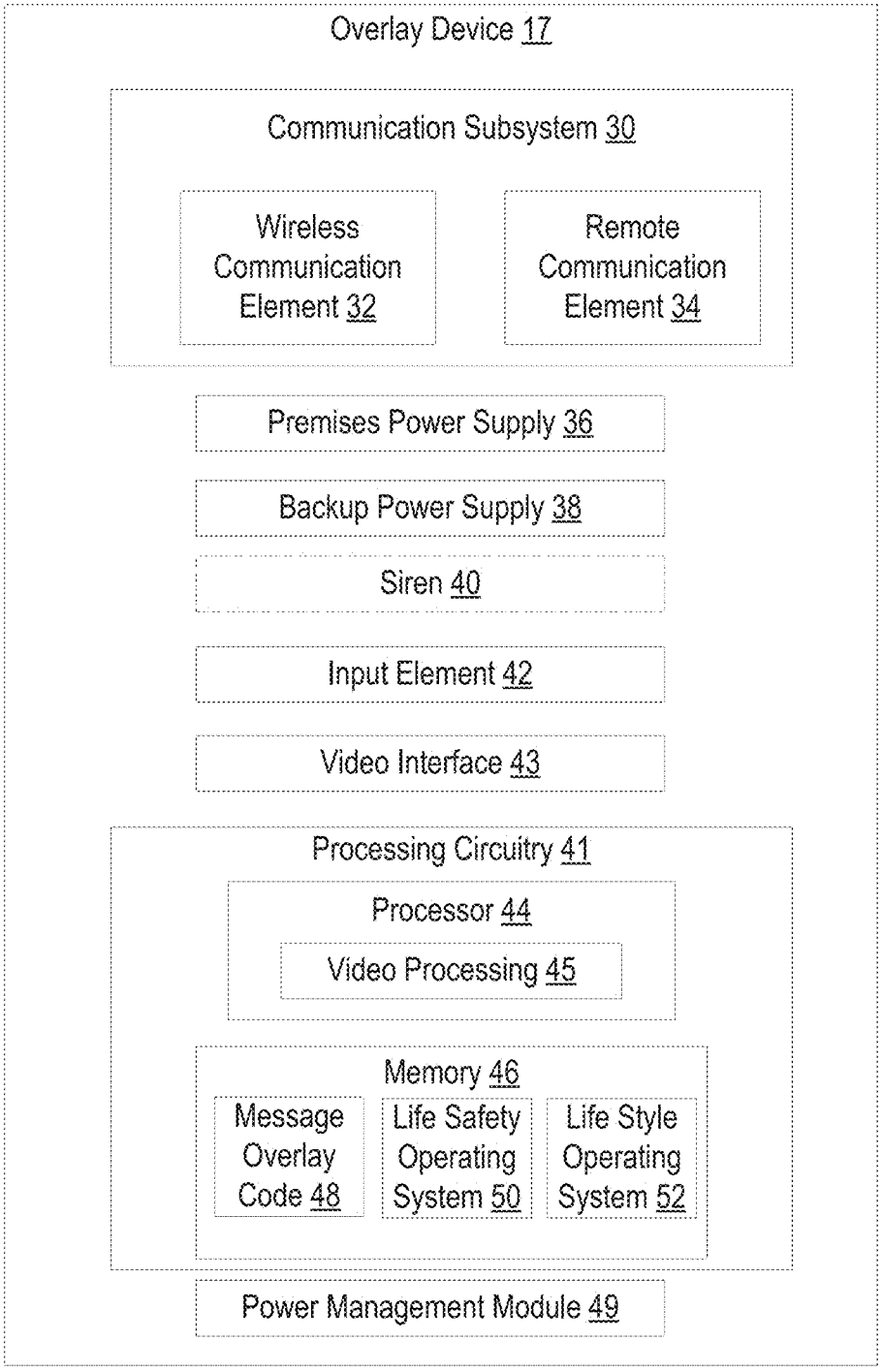
FIG. 2 is a block diagram of one embodiment of an overlay device configured to cause display of a premises status message in accordance with the principles of the invention.
Figure 3:
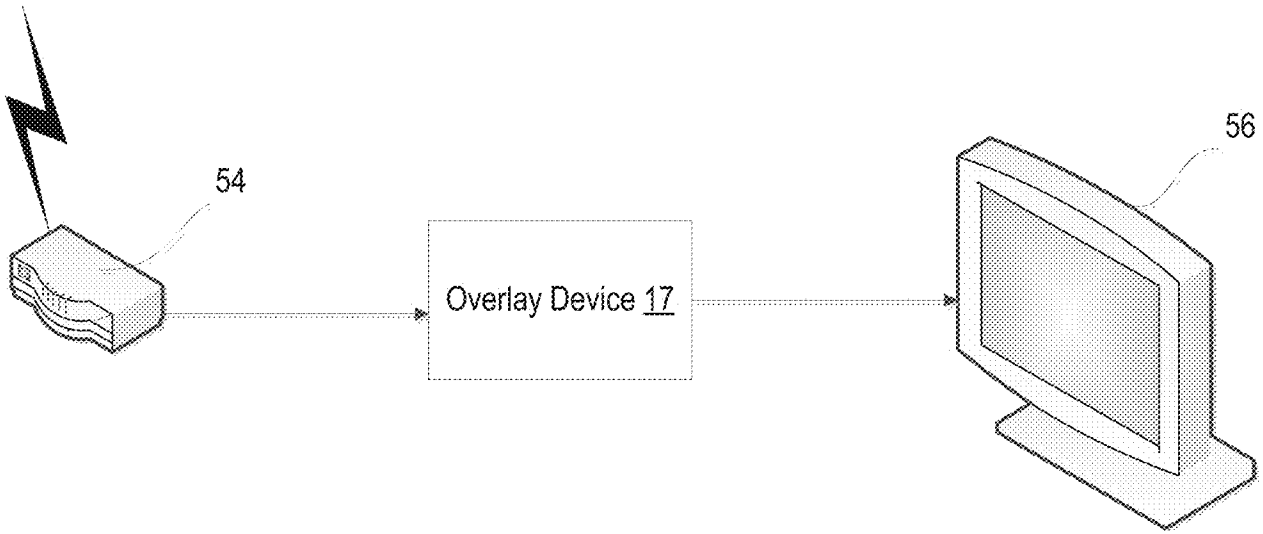
FIG. 3 is a diagram showing communication between a video receiver and a video monitor via an overlay device configured to cause display of a premises status message on the video monitor in accordance with the principles of the invention.
Figure 4:
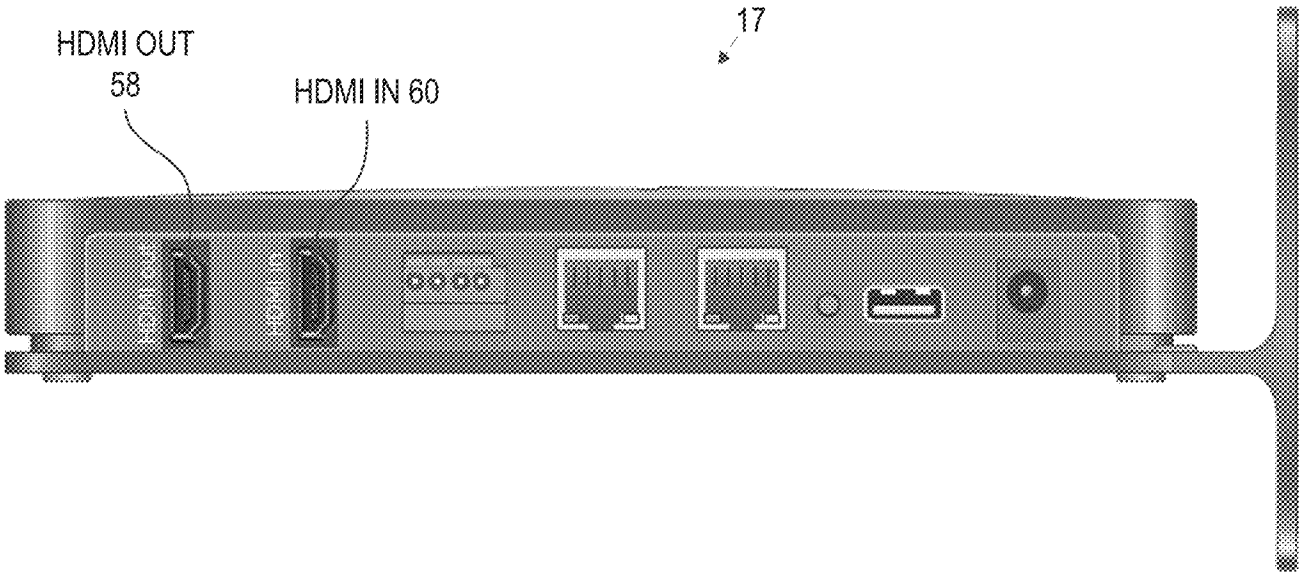
FIG. 4 shows an overlay device having HDMI input and output ports in accordance with the principles of the invention.

Case 1: Some embodiments include an overlay device such as an alarm gateway configured to plug into a video monitor input, such as an HDMI input, and configured to receive premises status messages from a premises device in order to display the premises status messages on the video monitor. An example of this embodiment is shown in FIGS. 2, 3 and 4 and described in detail below.

Figure 5:
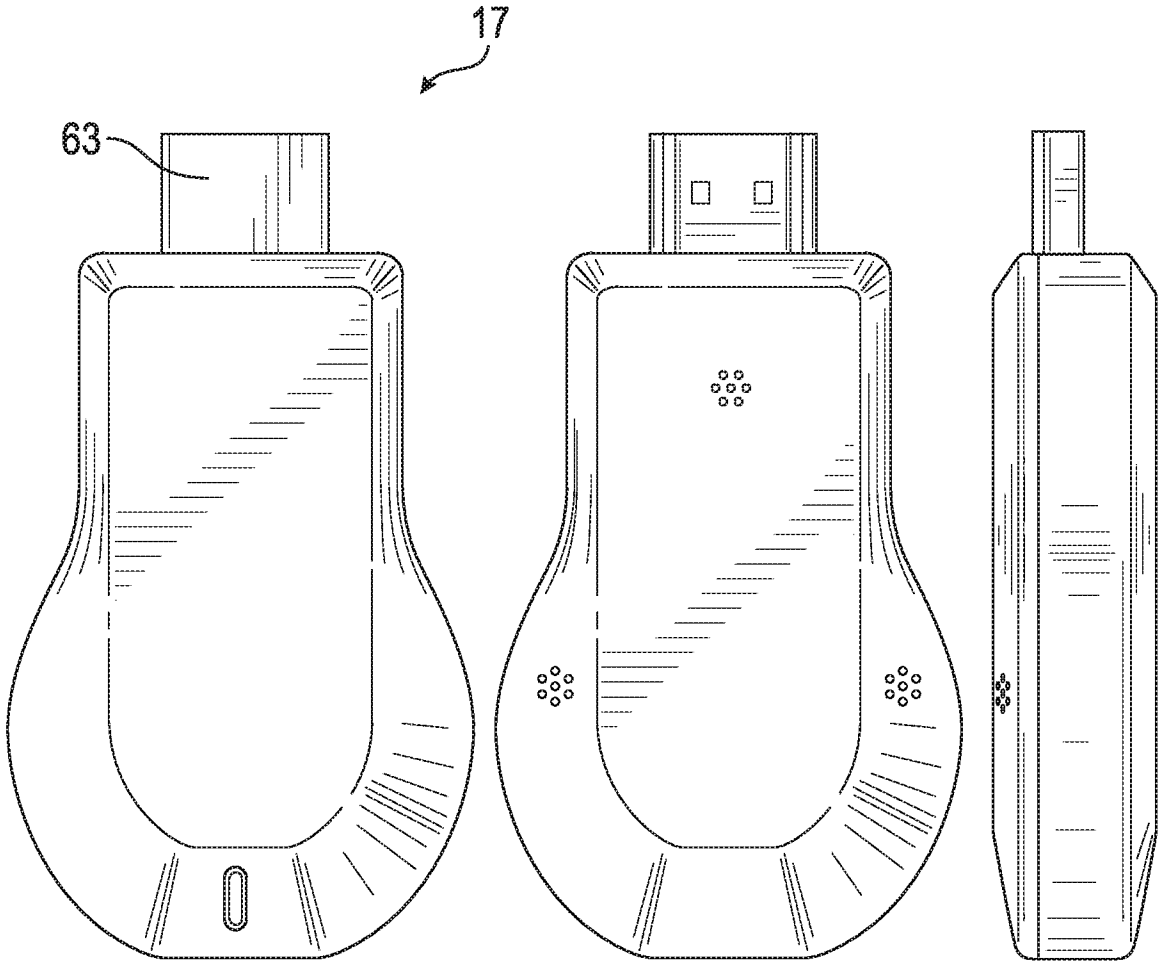
FIG. 5 shows another overlay device such as a dongle that is pluggable into a port of a video monitor and used to cause display of a premises status message on a video monitor in accordance with the principles of the invention.
Figure 6:
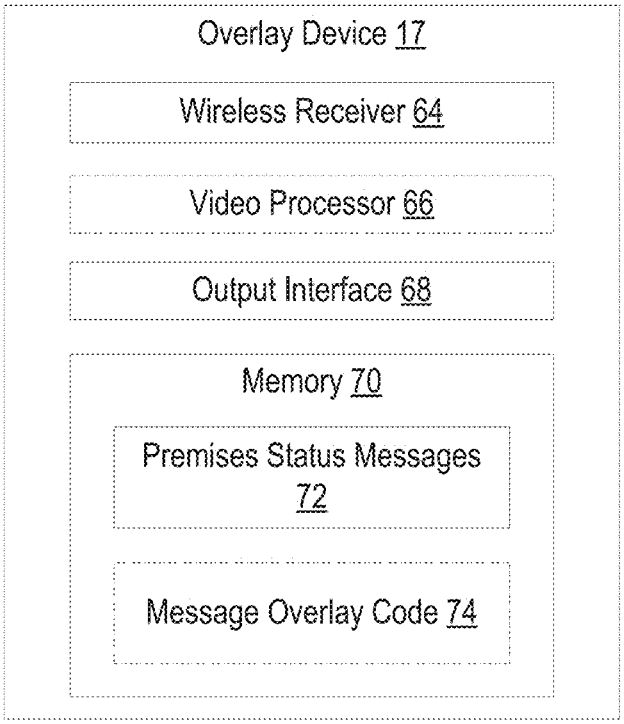
FIG. 6 is a block diagram of the other overlay device such as a dongle that is used to cause display of a premises status message on a video monitor in accordance with the principles of the invention.

Case 2: Some embodiments include an overlay device such as a dongle configured to plug into a video monitor input, such as an HDMI input, and that is configured to receive premises status messages from a premises device in order to display the premises status messages on the video monitor. An example of this embodiment is shown in FIGS. 5 and 6 and is described in detail below.

Referring now to the drawing figures in which like reference designators refer to like elements there is shown in FIG. 1 a security control system designated generally as "10." System 10 may include one or more user interface devices 12*a* to 12*n* (collectively referred to as "user interface device 12"), one or more premises devices 14*a* to 14*n* (collectively referred to as "premises device 14"), control unit 16, an overlay device 17, one or more networks 18*a* to 18*n* (collectively referred to as "network 18") and one or more remote monitoring centers 20*a* to 20*n* (collectively referred to as "remote monitoring center 20"), communicating with each other.

User interface device 12 may be a wireless device that allows a user to communicate with control unit 16. User interface device 12 may be a portable control keypad/interface 12*a*, computer 12*b*, mobile phone 12*c* and tablet 12*n*, among other devices that allow a user to interface with control unit 16. User interface device 12 may communicate at least with control unit 16 using one or more wireless communication protocols well known to those of ordinary skill in the art. For example, portable control keypad 12*a* may communicate with control unit 16 via a ZigBee based communication link 22, e.g., network based on Institute of Electrical and Electronics Engineers (IEEE) 802.15.4 protocols, and/or Z-wave based communication link 24, or over the premises' local area network, e.g., network based on Institute of Electrical and Electronics Engineers (IEEE) 802.11 protocols, user interface device 12 is discussed in detail with respect to FIG. 3.

Premises devices 14 may include one or more types of sensors, control and/or image capture devices. For example, the types of sensors may include various safety related sensors such as motion sensors, fire sensors, carbon monoxide sensors, flooding sensors and contact sensors, among other sensor types that are known in the art. The control devices may include, for example, one or more life style related devices configured to adjust at least one premises setting such as lighting, temperature, energy usage, door lock and power settings, among other settings associated with the premises or devices on the premises. Image capture devices may include a digital camera and/or video camera, among other image captures devices that are well known in the art. Premises device 14 may communicate with control unit 16 via proprietary wireless communication protocols and may also use Wi-Fi, both of which are known in the art. Other communication technologies can also be used, and the use of Wi-Fi is merely for example. Those of ordinary skill in the art will also appreciate that various additional sensors and control and/or image capture devices may relate to life safety or life style depending on both what the sensors, control and image capture devices do and how these sensors, control and image devices are used by system 10.

Control unit 16 may provide management functions such as power management, premises device management and alarm management, among other functions. In particular, control unit 16 may manage one or more life safety and life style features. Life safety features may correspond to security system functions and settings associated with premises conditions that may result in life threatening harm to a person such as carbon monoxide detection and intrusion detection. Life style features may correspond to security system functions and settings associated with video capturing devices and non-life-threatening conditions of the premises such as lighting and thermostat functions.

Control unit 16 may communicate with network 18 via one or more communication links. In particular, the communications links may be broadband communication links such as a wired cable modem or Ethernet communication link 26, and digital cellular communication link 28, e.g., long term evolution (LTE) based link, among other broadband communication links known in the art. Broadband as used herein may refer to a communication link other than a plain old telephone service (POTS) line. Ethernet communication link 26 may be an IEEE 802.3 or 802.11 based communication link. Network 18 may be a wide area network, local area network, wireless local network and metropolitan area network, among other networks known in the art. Network 18 provides communications between control unit 16 and remote monitoring center 20.

In some embodiments, the overlay device 17 is in communication with the control unit 16 and one or more premises devices 14. The overlay 17 may be configured to generate media to display premises status messages on a television or other video monitor. Media as used herein may include video, television, images, etc. In one or more embodiments, the overlay device 17 is configured to generate video to display premises status messages is shown in FIG. 2. This embodiment is for case 1, mentioned above, where the overlay device 17 is an alarm gateway. Overlay device 17 may include a communication subsystem 30 that is configured to provide communications with user interface device 12, premises device 14 and network 18. In particular, the communication subsystem 30 may include wireless communication element 32 and remote communication element 34. Wireless communication element 32 provides wireless communication with user interface device 12 and premises device 14. Wireless communication element 32 may support one or more wireless communication protocols such as ZigBee, Z-wave and Wi-Fi, e.g., IEEE 802.11, among others wireless communications protocols that support wireless data transfer.

Wireless communication element 32 may be composed of one or more hardware components in which each hardware component is configured to provide wireless communication using a specific protocol. For example, wireless communication element 32 may include a ZigBee hardware component configured to provide ZigBee based communications and a Z-wave hardware component configured to provide Z-wave based communications. The hardware components associated with wireless communication element 32 may be internal components within overlay device 17 such that these features are built-in or standard features. Alternatively, any one or more of the hardware components associated with wireless communication element 32 may be external components that may be replaced by a user, homeowner or installer. For example, the ZigBee and Z-wave hardware component modules may be internal components while the Wi-Fi hardware component may be an external component that allows for upgrading. Wireless communication element 32 may broadcast a wireless signal so that user interface device 12 may connect directly to overlay device 17. For example, wireless communication element 32 may provide a Wi-Fi encrypted service set identifier (SSID) and path for communication with multiple user interface devices 12.

By supporting a plurality of wireless communication protocols, wireless communication element 32 enables overlay device 17 to be used with a variety of user interface devices 12 and premises devices 14 that are designed to work using only a specific wireless communication protocol. Supporting a plurality of wireless communication protocols allows easy upgrading of existing user interface device 12 and premises device 14, and provides for integration of overlay device 17 with equipment of various vendors that may incorporate different wireless protocols. Wireless communication element 32 may provide two-way voice communication with user interface device 12, which is then communicated with remote monitoring center 20. For example, wireless communication element 32 may support voice over Internet protocol (VoIP) based communications. In one embodiment, component parts of wireless communication element 32, e.g., an IEEE 802.11 communication module, may also be part of the remote communication element 34 so that the wireless communication protocols, e.g., IEEE 802.11 protocols, can be used to communicate with remote monitoring center 20. In other words, one or more specific communication modules of wireless communication element 32 can also be part of remote communication element 34.

Remote communication element 34 is configured to provide broadband communications with remote monitoring center 20 via network 18. For example, remote communication element 34 may be an Ethernet based hardware component that provides communication with network 18. Alternatively, or in addition to an Ethernet based hardware component, remote communication element 34 may include a Wi-Fi (IEEE 802.11) hardware component that provides communication with a home or other premises network, e.g., a home wireless network, and may utilize some of the same components as wireless communication element 32. The remote communication element 34 may also include a cellular radio hardware component that provides communications with at least one cellular network such as an LTE based cellular network. Overlay device 17 may use Ethernet communication link 26 as a primary communication link such that the cellular communication link is used for broadband communications when the Ethernet or primary communication link is not functioning properly such as during a power outage where a home network is unavailable, i.e., home network router has no power.

Overlay device 17 may include premises power supply 36 that is configured to provide power to alarm gateway. For example, premises power supply 36 may provide power to overlay device 17 via a home alternating current (AC) power outlet or other power outlets that are known in the art. Premises power supply 36 may be a primary power supply such that overlay device 17 operates using power from the premises power supply 36 when available. Overlay device 17 may also include back-up power supply 38 that provides power during premises power supply failure. Back-up power supply 38 may include one or more disposable or rechargeable batteries that are configured to provide enough power to operate overlay device 17 for first predetermined amount of time and activate siren 40 for a second predetermined amount of time, e.g., a user can access the security system for at least twenty-four hours while overlay device 17 is powered by back-up power supply 38 while the siren can be activated and operate after the twenty-four hour period.

Siren 40 may be an eighty-five decibel (dB) siren, among other audible devices known in the art. Siren 40 may be an optional component in overlay device 17 such that audible alerts are generated by user interface device 12, e.g., portable control keypad/interface 12*a*, and not overlay device 17. Moreover, overlay device 17 may include at least one universal serial bus port (USB) to receive power from a laptop or other device with a USB interface. Other port types capable of providing power to overlay device 17 may be used based on design goals.

Input element 42 may be configured to receive input data from a user. For example, input element 42 may be a ten-number keypad that enables a user to arm and disarm system 10. Input element 42 allows for an alternative or back-up way of arming and disarming the system 10 when no user interface device 12 is available to a user. Other input elements may be used as are known in the art. Overlay device 17 may include one or more indicators such as light emitting diodes (LEDs) that may indicate the status of overlay device 17. For example, a first LED is turned on when security control panel is powered, a second LED is turned on when the system is armed or disarmed, a third LED is turned on when an internet protocol connection is connected, and a fourth LED may be turned on when the cellular connection has sufficient strength. Also, he first LED may be made to flash during low power conditions.

In some embodiments, the overlay device 17 includes processing circuitry 41 that includes a processor 44 and a memory 46, the memory 46 containing instructions which, when executed by the processor 44, configure processor 44 to perform the one or more functions described herein. In addition to a traditional processor and memory, processing circuitry 41 may include integrated circuitry for processing and/or control, e.g., one or more processors and/or processor cores and/or FPGAs (Field Programmable Gate Array) and/or ASICs (Application Specific Integrated Circuitry).

The processing circuitry 41 may include and/or be connected to and/or be configured for accessing (e.g., writing to and/or reading from) memory 46, which may include any kind of volatile and/or non-volatile memory, e.g., cache and/or buffer memory and/or RAM (Random Access Memory) and/or ROM (Read-Only Memory) and/or optical memory and/or EPROM (Erasable Programmable Read-Only Memory). Such memory 46 may be configured to store code executable by control circuitry and/or other data, e.g., data pertaining to communication, e.g., configuration and/or address data of nodes, etc. The processor circuitry 41 may be configured to control any of the methods described herein and/or to cause such methods to be performed. Corresponding instructions may be stored in the memory 46, which may be readable and/or readably connected to the processor 44. In other words, the processing circuitry 41 may include a controller, which may comprise a microprocessor and/or microcontroller and/or FPGA (Field-Programmable Gate Array) device and/or ASIC (Application Specific Integrated Circuit) device. It may be considered that the processing circuitry 41 includes or may be connected or connectable to memory 46, which may be configured to be accessible for reading and/or writing by the controller and/or processor 44. Thus, the processor 44 may be a central processing unit (CPU) that executes computer program instructions stored in memory 46 to perform the functions described herein. Memory 46 may include non-volatile and volatile memory. For example, non-volatile memory may include a hard drive, memory stick, flash memory and the like. Also, volatile memory may include random access memory and other memory known in the art.

Memory 46 may store message overlay code 48, life safety operating system 50 and life style operating system 52, among other data and/or modules. Message overlay code 48 includes instructions, which when executed by processor 44, causes processor 44 to perform the process of FIG. 8. Power management module 49 includes instructions, which when executed by processor 44, causes processor 44 to perform power management processes, including processes to power "ON" or activate a video monitor 56 when a premises status message is to be displayed on video monitor 56. Life safety operating system 50 is configured to provide life safety features associated with system 10. Life style operating system 52 is configured to provide life style features associated with system 10.

The overlay device 17 includes a video interface 43 which may include an HDMI input port and HDMI output port or input and output port conforming to another transmission standard such as HDMI-consumer electronic control (CEC). Referring to FIG. 3, in some embodiments, the input port receives video from a source such as a video receiver 54 which receives media signals from a cable TV provider or a satellite TV provider. Thus, an HDMI cable, for example, that would otherwise be routed from the video receiver to the video monitor such as a television set may be routed to an HDMI input of the video interface 43. A second HDMI cable is then routed from the HDMI output of the video interface 43 to the video monitor 56. FIG. 4 shows the HDMI output 58 and HDMI input 60 in the overlay device 17. In some embodiments, at least some of the functionality of the overlay device 17 may be implemented in a security control unit such as the control unit 16 separate from the overlay device 17.

In some embodiments, the processor 44 may also initiate a power on signal that is transmitted to the video monitor 56 to cause the video monitor 56, such as a television monitor, to power on if in a powered off condition when a premises status message is an alarm or other message deemed important to display immediately on the video monitor 56.

The video received from the HDMI cable that is input to the video interface 43 input port is received by a video processor 45 of the processor 44 to be combined with one or more premises status messages, such that the media signal output at the output port causes the video monitor 56 to display a picture of the video from the video receiver combined with a display of the premises status messages. For example, a display of a football game may be combined with a picture-in-picture display of a premises status message or the premises status message may be superimposed over the main picture, e.g., superimposed over the football game. A premises status message may include an alarm message and/or a sensor-detected condition message, for example. In some embodiments, the premises status messages are displayed as a moving caption at the bottom or top of the screen of the video monitor 56.

In addition to displaying the premises status message, the processor 44 may be configured to cause a changing of a volume of sound of the video monitor 56 when displaying the premises status message. In some embodiments, the processor 44 may be configured to suppress audio volume associated with the television media signal and produce an audio signal associated with the premises status message. Thus, in addition to displaying a premises status message, the video monitor 56 may be caused to produce an audio message concerning the premises status.

As an alternative to the configuration of FIG. 4, some embodiments provide for display of a TV signal with a premises status message, not by channeling the media signal to one embodiment of the overlay device 17, but by using another embodiment of the overlay device 17, namely, a dongle that plugs into the video monitor 56 itself. FIG. 5 shows an embodiment of such a dongle, which may have a universal serial bus (USB) connector for power and an HDMI connector 63 that plugs into a corresponding HDMI receiving port on the video monitor 56. The dongle has a wireless receiver that receives premises information concerning premises status. In some embodiments, the dongle has a single port 63 that is an output port for sending data from the dongle to the video monitor 56. In some alternative embodiments, an additional port, an input port (not shown in FIG. 5), receives media signals such as TV video signals from the video receiver 54 or the other embodiment of the overlay device 17, i.e., alarm gateway, via a cable such as an HDMI cable. In such embodiments, the media signals are combined with premises status messages in the dongle.

Thus, in some embodiments, the dongle receives the media signal from the video receiver 54 wirelessly. In these embodiments, the dongle includes an HDMI-CES protocol that provides the media signal to the video monitor 56 to be displayed thereon. In other embodiments, the dongle does not receive a media signal but instead passes a premises status message to the video monitor 56 to be displayed alone or in combination with the media signal received from the video monitor 56 directly from the video receiver 54. In these embodiments, the dongle may instruct the video monitor 56 to display one or both of the media signal and the premises status message. In some embodiments, in addition to being able to receive signals from the alarm gateway, the video receiver 54 or the premises devices 14, the wireless receiver 64 can also communicate with a Wi-Fi access point.

FIG. 6 is a block diagram of the dongle embodiment of the overlay device 17 that includes a wireless receiver 64 that wirelessly receives premises information signals from the video receiver 54 or the alarm gateway or from premises devices 14. In some embodiments, the premises information signals received by the wireless receiver 64 are processed by a video processor 66. The video processor 66 would then combine video received from video receiver 54 with the premises status messages. The output interface 68 interfaces with the video monitor 56 to provide the premises status messages or the combined media signals/premises status messages to the video monitor 56. When the premises information signals are received from the video receiver 54 or the alarm gateway, the premises information signals are interpreted as premises status messages. When the premises information signals are received from premises devices 14, the premises information signals may be processed by the video processor 66 to generate the premises status messages.

Figure 7:
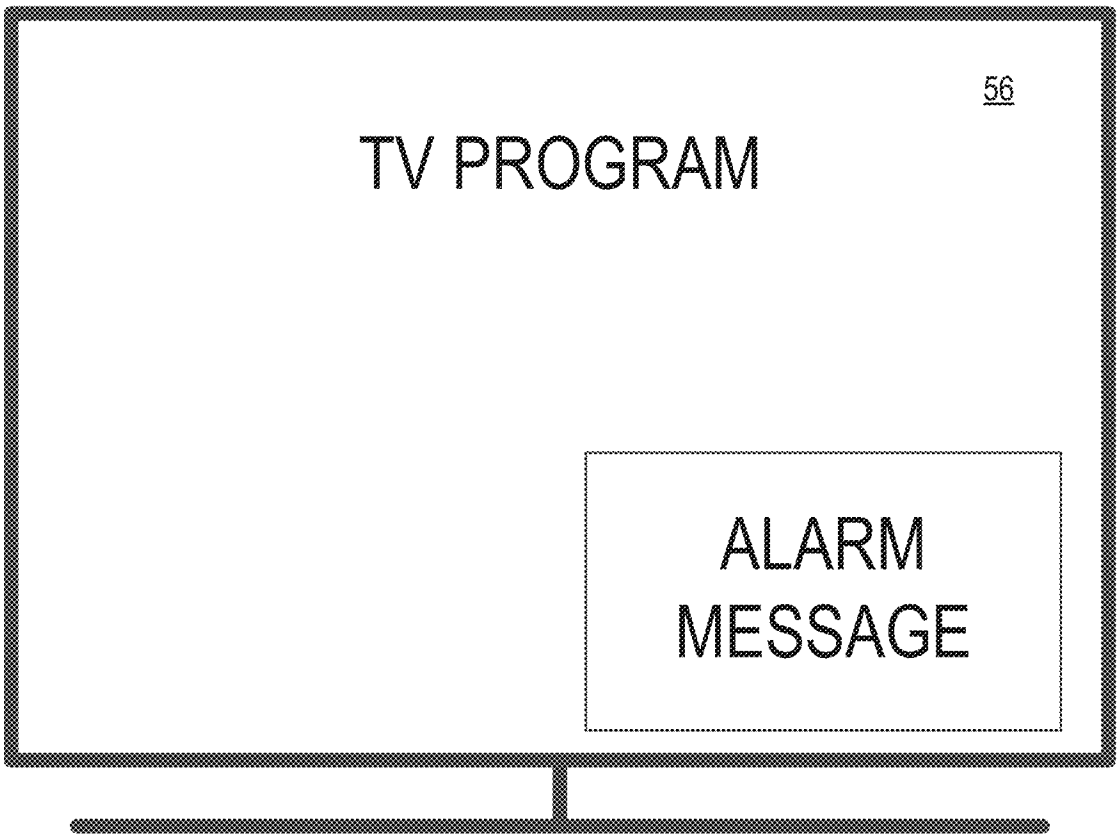
FIG. 7 is a video display showing a combination of video and a picture in picture of an alarm message in accordance with the principles of the invention.

The memory 70 stores the premises status messages 72 and message overlay code 74. Message overlay code 74 includes instructions, which when executed by video processor 66, causes the video processor 66 to perform the process of FIG. 9. When the premises information signals are received from the premises devices 14, the premises information signals may be processed by the video processor 66 to generate the premises status messages which are then combined with the media signals to produce a display on the video monitor 56 of the video and the premises status messages. A diagram of a combination of video and premises status messages that can be displayed on the video monitor 56 is shown in FIG. 7. The video processor 66 can also handle messaging and computational functions as may be desired and implemented by a central processing unit (CPU), or the CPU can be a separate element within the dongle.

Note that in some embodiments, the power for the dongle is provided from the video monitor 56 via USB from the video monitor 56. In alternative embodiments, power is provided on board the dongle via a battery (not shown) or via a power outlet at the premises. When powered by battery or power outlet at the premises, the video processor also may initiate powering on of the video monitor 56 when the video monitor 56 is powered off and a premises condition is one of an alarm, intrusion or other premises condition warranting immediate display on the video monitor 56, so that the premises status message can be displayed on the video monitor 56.

Thus, there are at least two embodiments of the dongle. One embodiment has an HDMI output interface 68 that includes an output port to plug into the video monitor 56. In this embodiment, the video processor 66 processes premises information signals received wirelessly from the premises devices 14 to generate premises status messages. The video processor 66, executing message overlay code 74, may instruct the video monitor 56 to display only media signals such as TV video signals received from the video receiver 54 or display a combination of media signals and premises status messages received at the video monitor 56 from the dongle.

In some embodiments, in addition to displaying a premises status message, one or more icons can be displayed that may be selected wirelessly by remote control in response to the premises condition indicated by the premises status message. In some embodiments, the dongle includes a wireless transceiver that communicates with the processor 66 and a remote control via BLUETOOTH or via a wireless access point using a traditional communication protocol such as Wi-Fi, etc. For example, a premises condition may be an opening of a front door of the premises, the occupant of the premises may delete the premises status message that indicated this condition from the video monitor 56 such as a television display. As another example, an intrusion alarm may be displayed as a premises status message. Upon seeing this premises status message, the premises occupant may point and click on the message to cause display of another message which indicates at which door or window the intrusion occurred.

Figure 8:
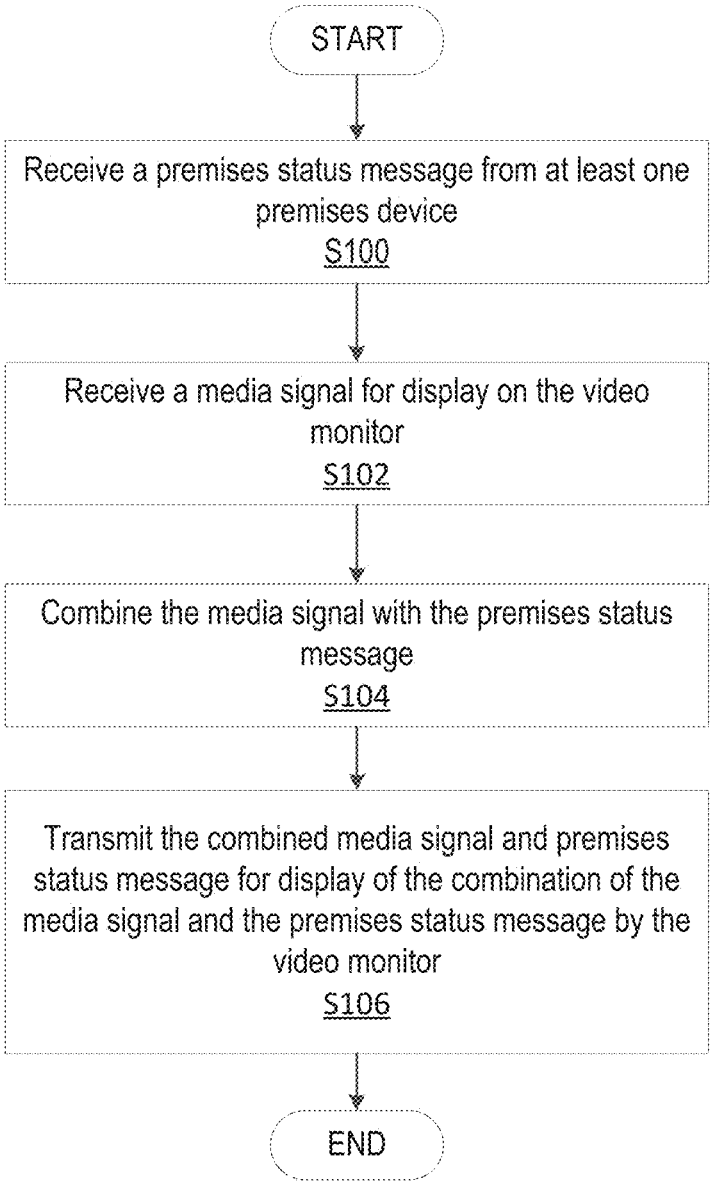
FIG. 8 is a flowchart of one embodiment of an overlay process for premises status message display on a video monitor in accordance with the principles of the invention.

FIG. 8 is a flowchart of one embodiment of the process of message overlay code 74 for premises status message display on a video monitor 56. The process includes receiving a premises status message from at least one premises device (Block S100). A media signal for display on the video monitor 56 is received (Block S102). The media signal is combined with the premises status message (Block S104). The combined media signal and premises status message is transmitted for display of the combination of the media signal and the premises status message by the video monitor 56 (Block S106).

According to one or more embodiments, a high definition multimedia interference (HDMI) interface including an HDMI input port and an HDMI output port, the receiving of the media signal and transmitting of the combined media signal occurring via the HDMI interface. According to one or more embodiments, the memory 46 or memory 70 contains further instructions, which when executed by the processor 44 or processor 66, cause the processor 44 or processor 66 to: determine the premises status message correspond to a premises condition for immediate display on the video monitor 56, and when the video monitor is powered OFF, initiate a power ON sequence to power the video monitor 56 to an ON state to display the premises status message indicating the premises condition.

According to one or more embodiments, the premises status message is caused to be displayed in a picture-in-picture format. According to one or more embodiments, the alarm gateway is responsive to a wirelessly transmitted remote signal that changes the displayed premises status message. According to one or more embodiments, the memory 46 or memory 70 contains further instructions, which when executed by the processor 44 or processor 66, cause the processor 44 or processor 66 to change a volume of sound of the video monitor 56 when displaying the premises status message. According to one or more embodiments, the media signal is a television signal received from one of a cable television provider and satellite television provider.

According to one or more embodiments, the display of the combination of the media signal and the premises status message by the video monitor 56 includes superimposing the premises status message over a displayed video of the media signal. According to one or more embodiments, the premises device 14 is a sensor device.

Figure 9:
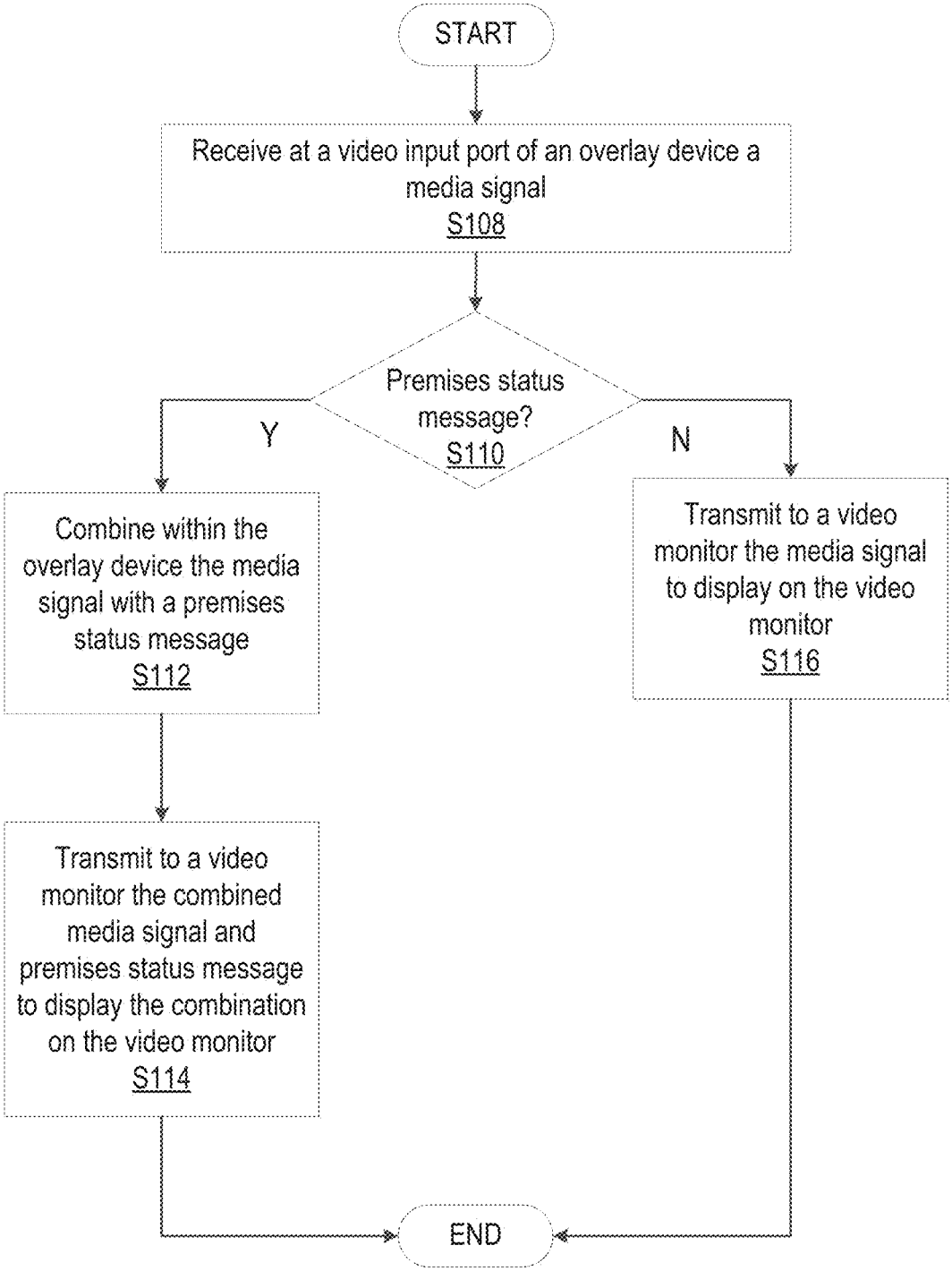
FIG. 9 is a flowchart of another embodiment of an overlay process for premises status message display on a video monitor in accordance with the principles of the invention.

FIG. 9 is a flowchart of another embodiment of the process of message overlay code 74 for premises status message display on a video monitor 56. The process includes receiving, at a video input port of an overlay device 17, a media signal (Block S108). If a premises status message is received via input element 42 (Block S110), then the process also includes combining via the processor 44, within the overlay device 17, the media signal with the premises status message (Block S112). The process further includes transmitting to the video monitor 56 the combined media signal and premises status message to display the combination of the media signal and the premises status message on the video monitor 56 (Block S114). If the premises status message is not received, the process includes transmitting the media signal to be displayed on the video monitor 56 (Block S116).

Figure 10:
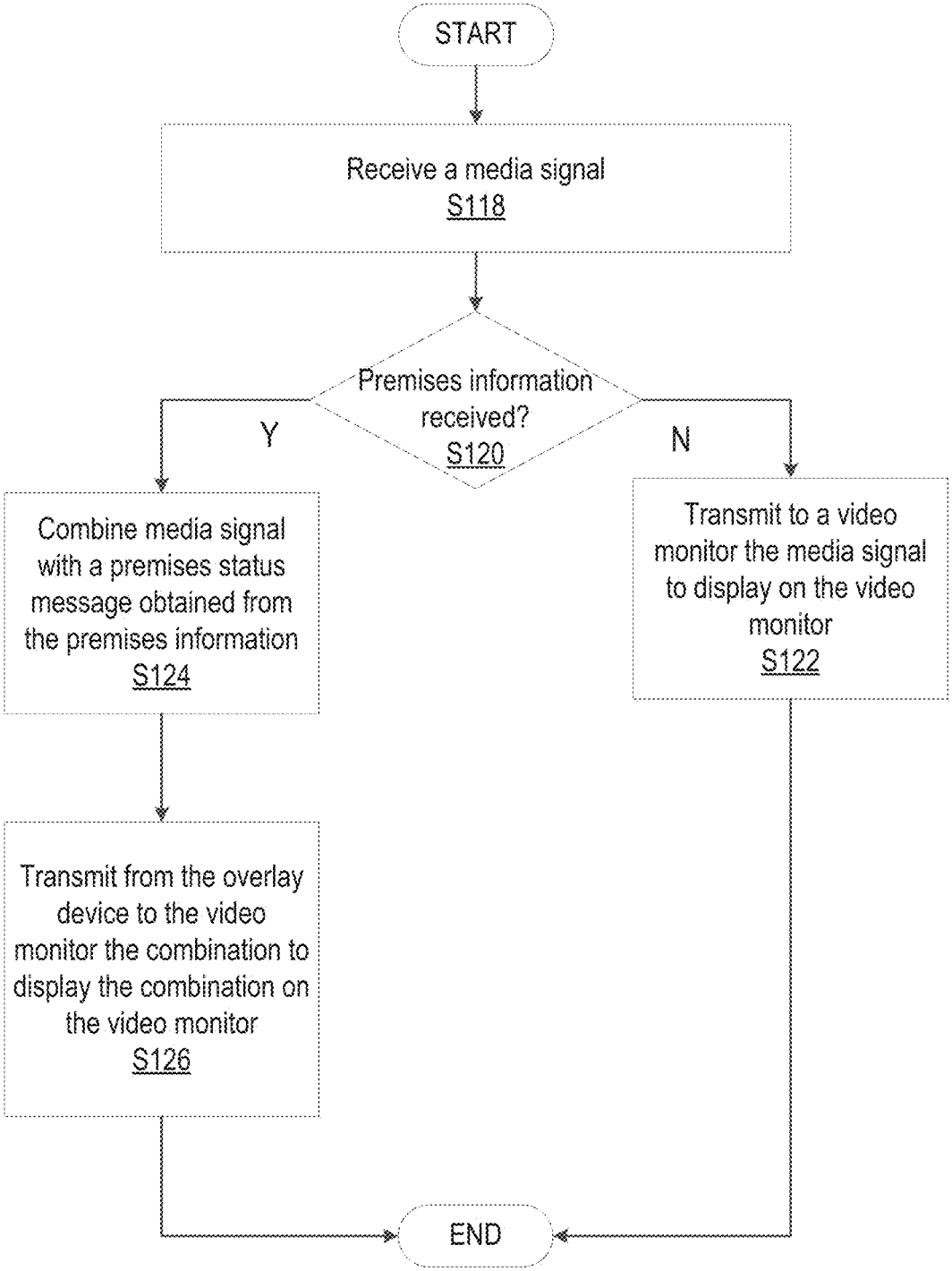
FIG. 10 is a flowchart of yet another embodiment of an overlay process for premises status message display on a video monitor in accordance with the principles of the invention.

FIG. 10 is a flowchart of another embodiment of the process of message overlay code 74 for premises status message display on a video monitor 56. The process includes receiving, at a two-port overlay device 17 such as dongle 62 pluggable into the video monitor 56, a media signal (Block S118). If premises information is received wirelessly from alarm gateway (Block S120), the process proceeds to Block S124, where the media signal from the video monitor 56 is combined via the processor 66 with a premises status message obtained from the premises information (Block S124). The process further includes transmitting via the output interface 68 to the video monitor 56 from the dongle 62 the combined media signal and premises status message to display the combination of the media signal and the premises status message on the video monitor 56 (Block S126). If the premises information is not received (Block S120), then the media signal is displayed on the video monitor 56 without the premises information (Block S122).

Figure 11:
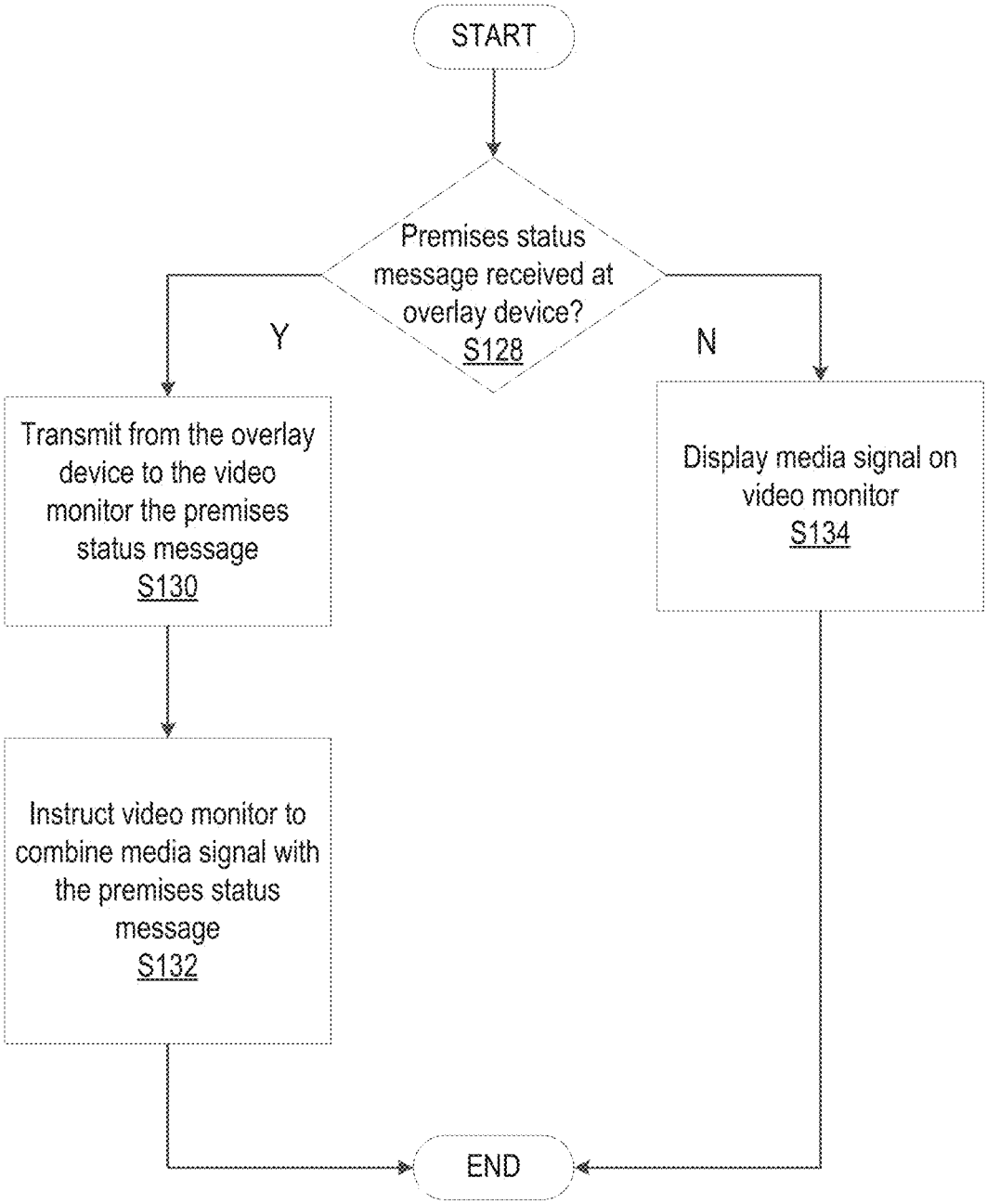
FIG. 11 is a flowchart of yet another embodiment of an overlay process for premises status message display on a video monitor in accordance with the principles of the invention.

FIG. 11 is flowchart of an exemplary embodiment for premises status message display on a video monitor 56. The process includes receiving, via the wireless receiver 64, at overlay device 17 such as single-port dongle pluggable into the video monitor 56 a premises status message (Block S128). If a premises status message is received, the dongle transmits, via the output interface 68, the premises status message to the video monitor 56 (Block S130). The dongle then instructs the video monitor 56 to combine the media signal with the premises status message (Block S132). If a premises status message is not received (Block S128), the media signal is displayed on the video monitor 56 without the premises status message (Block S134).

Thus, in some embodiments, an overlay device 17 has an HDMI input from a programming source such as cable TV provider or satellite TV provider, Blue ray device, gaming device or other application. Some embodiments include a dongle without an HDMI input from such programming sources. In these embodiments, the TV being used to display video and premises status messages incorporates HDMI consumer electronics control (HDMI-CEC) technology including CEC power and input features that allow the overlay device 17 such as alarm gateway or the dongle to turn on the TV and change its input to display premises status messages. In such embodiments, the HDMI-CEC enabled TV may be used as an HDMI sink device, and the overlay device 17 may be used as HDMI source devices. In some embodiments, the overlay device 17 may have HDMI-CEC technology to allow these devices to cause overlay of premises status messages onto the TV screen while playing a media signal from any of the TV sources available.

Figure 12:
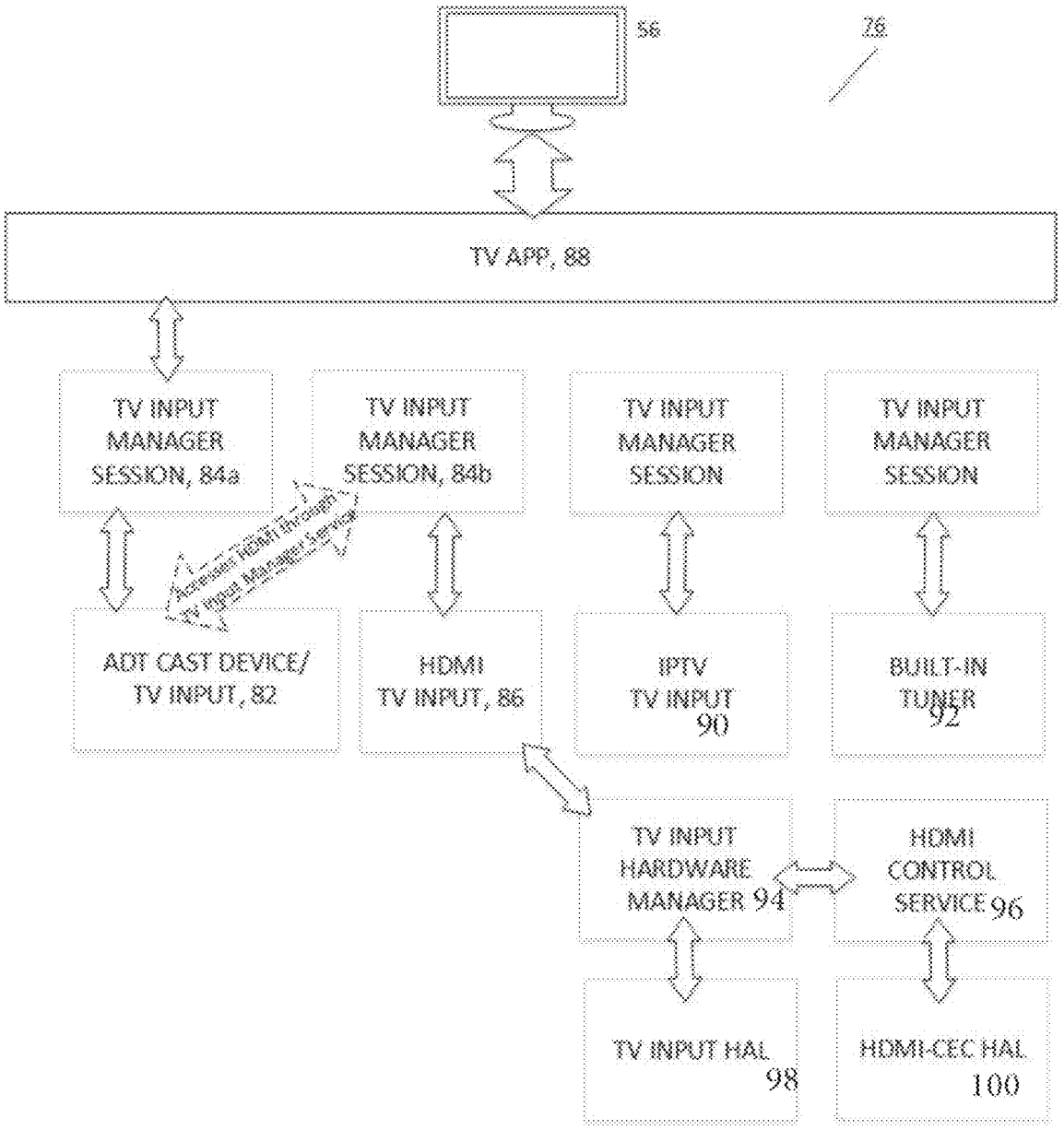
FIG. 12 is a block diagram of an exemplary video system for displaying video and premises status messages on a video monitor.

FIG. 12 is a block diagram of a video system 76 for displaying video such as TV video signals and premises status messages on a video monitor 56. The video system 76 includes a cast device/TV input device 82, TV input manager sessions 84*a* and 84*b*, referred to collectively herein as TV input manager sessions 84, HDMI TV input 86 and TV applications 88. The cast device/TV input device 82 may be implemented as the overlay device 17. The cast device/TV input device 82 communicates with TV input manager session 84 and renders the premises status message. The premises status message may be inset as an overlay, as shown in FIG. 7, or be displayed full screen. In some cases, the overlay device 17 directs the video monitor 56 to switch to the HDMI TV input 86. The HDMI TV input 86 may provide for blue-ray, satellite or cable input. The TV application 88 may facilitate display of applications such as games and you tube, for example. The TV App 88 is responsible for knowing which system TV Input is active, meaning which TV input is selected by the user. Note that the video system 76 may also include an Internet Protocol (IP) TV input 90 (e.g., Netflix), a built-in tuner 92 (to tune channels received by antenna), a TV input hardware manager 94, and HDMI control service 96, a TV input hardware abstraction layer (HAL) 98 and an HDMI-CEC HAL 100.

In the example of FIG. 12, the cast device/TV input device 82 is provided by the security and lifestyle monitoring service provider. Since the cast device/TV input device 82 does not directly access the HDMI video feed coming in, the HDMI video feed may go through the TV Input Manager 84 and use the HDMI TV Input 86 provided by the device manufacturer. Through the TV Input Manager 84, the cast device/TV Input device 82 can communicate with the HDMI TV Input 86 and ask the HDMI TV Input 86 to show the video on HDMI1. Therefore, the cast device/TV Input device 82 can control the TV while the manufacturer-provided HDMI TV Input 86 renders the video.

As will be appreciated by one of skill in the art, the concepts described herein may be embodied as a method, data processing system, and/or computer program product. Accordingly, the concepts described herein may take the form of an entirely hardware embodiment, an entirely software embodiment or an embodiment combining software and hardware aspects all generally referred to herein as a "circuit" or "module." Furthermore, the disclosure may take the form of a computer program product on a tangible computer usable storage medium having computer program code embodied in the medium that can be executed by a computer. Any suitable tangible computer readable medium may be utilized including hard disks, CD-ROMs, electronic storage devices, optical storage devices, or magnetic storage devices.

Some embodiments are described herein with reference to flowchart illustrations and/or block diagrams of methods, systems and computer program products. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer (to create a special purpose computer), special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory or storage medium that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Computer program code for carrying out operations of the concepts described herein may be written in an object oriented programming language such as Java® or C++. However, the computer program code for carrying out operations of the disclosure may also be written in conventional procedural programming languages, such as the "C" programming language. The program code may execute entirely on the user's computer, partly on the user's computer, as a stand-alone software package, partly on the user's computer and partly on a remote computer or entirely on the remote computer. In the latter scenario, the remote computer may be connected to the user's computer through a local area network (LAN) or a wide area network (WAN), or the connection may be made to an external computer (for example, through the Internet using an Internet Service Provider).

Many different embodiments have been disclosed herein, in connection with the above description and the drawings. It will be understood that it would be unduly repetitious and obfuscating to literally describe and illustrate every combination and sub-combination of these embodiments. Accordingly, all embodiments can be combined in any way and/or combination, and the present specification, including the drawings, shall be construed to constitute a complete written description of all combinations and sub-combinations of the embodiments described herein, and of the manner and process of making and using them, and shall support claims to any such combination or sub-combination.

It will be appreciated by persons skilled in the art that the present embodiments are not limited to what has been particularly shown and described herein above. In addition, unless mention was made above to the contrary, it should be noted that all of the accompanying drawings are not to scale. A variety of modifications and variations are possible in light of the above teachings without departing from the scope of the following claims.

What is claimed is:

1. An overlay device for premises status message display on a video monitor, the overlay device comprising:

a processor in communication with a memory, the memory storing instructions, which when executed by the processor, cause the processor to:

receive a premises status message from at least one premises device;

receive a media signal for display on the video monitor;

combine the media signal with the premises status message;

determine if the premises status message corresponds to a premises intrusion alarm for immediate display on the video monitor and, if the premises status message corresponds to a premises intrusion alarm for immediate display on the video monitor and the video monitor is powered OFF, initiate a power ON sequence to power the video monitor to an ON state; and transmit the combined media signal and premises status message for display of the combination of the media signal and the premises status message by the video monitor; and a communication element configured to, in response to a premises intrusion alarm, provide two-way voice over internet protocol (VoIP) based communication between a user interface device and a remote monitoring center.

2. The overlay device of claim 1, further comprising:

a high definition multimedia interference (HDMI) interface including an HDMI input port and an HDMI output port, the receiving of the media signal and transmitting of the combined media signal occurring via the HDMI interface.

3. The overlay device of claim 1, wherein the premises status message is caused to be displayed in a picture-in-picture format.

4. The overlay device of claim 1, wherein the overlay device is responsive to a wirelessly transmitted remote signal that changes the displayed premises status message.

5. The overlay device of claim 1, wherein the memory contains further instructions, which when executed by the processor, cause the processor to change a volume of sound of the video monitor when displaying the premises status message.

6. The overlay device of claim 1, wherein the media signal is a television signal received from one of a cable television provider and satellite television provider.

7. The overlay device of claim 1, wherein the display of the combination of the media signal and the premises status message by the video monitor includes superimposing the premises status message over a displayed video of the media signal.

8. The overlay device of claim 1, wherein the premises device is a sensor device.

9. A method for an overlay device for premises status message display on a video monitor, the method comprising:

receiving a premises status message from at least one premises device;

receiving a media signal for display on the video monitor;

combining the media signal with the premises status message;

determining if the premises status message corresponds to a premises intrusion alarm for immediate display on the video monitor and, if the premises status message corresponds to a premises intrusion alarm for immediate display on the video monitor and the video monitor is powered OFF, initiating a power ON sequence to power the video monitor to an ON state;

transmitting the combined media signal and premises status message for display of the combination of the media signal and the premises status message by the video monitor; and in response to a premises intrusion alarm, providing two-way voice over internet protocol (VoIP) based communication between a user interface device and a remote monitoring center.

10. The method of claim 9, the receiving of the media signal and transmitting of the combined media signal occurring via an HDMI interface of the overlay device, the HDMI interface including an HDMI input port and an HDMI output port.

11. The method of claim 9, wherein the premises status message is caused to be displayed in a picture-in-picture format.

12. The method of claim 9, wherein the overlay device is responsive to a wirelessly transmitted remote signal that changes the displayed premises status message.

13. The method of claim 9, further comprising changing a volume of sound of the video monitor when displaying the premises status message.

14. The method of claim 9, wherein the media signal is a television signal received from one of a cable television provider and satellite television provider.

15. The method of claim 9, wherein the display of the combination of the media signal and the premises status message by the video monitor includes superimposing the premises status message over a displayed video of the media signal.

16. The method of claim 9, wherein the premises device is a sensor device.

17. An overlay device for premises status message display on a video monitor, the overlay device comprising:

a processor in communication with a memory, the memory storing instructions, which when executed by the processor, cause the processor to:

receive a premises status message from at least one premises device, the at least one premises device include at least one sensor;

receive a media signal for display on the video monitor;

combine the media signal with the premises status message;

determine if the premises status message corresponds to a premises intrusion alarm for immediate display on the video monitor and, if the premises status message corresponds to a premises intrusion alarm for immediate display on the video monitor and the video monitor is powered OFF, initiate a power ON sequence to power the video monitor to an ON state; and transmit the combined media signal and premises status message for display of the combination of the media signal and the premises status message by the video monitor; and a communication element configured to, in response to a premises intrusion alarm, provide two-way voice over internet protocol (VoIP) based communication between a user interface device and a remote monitoring center; and the display of the combination of the media signal and the premises status message by the video monitor includes superimposing the premises status message over a displayed video of the media signal.

18. The overlay device of claim 17, wherein the processor is further caused to:

suppress audio volume associated with the media signal; and produce an audio signal associated with the premises status message.

* * * * *